US005836559A

United States Patent [19]

Ronci

[11] Patent Number: 5,836,559

[45] Date of Patent: Nov. 17, 1998

[54] CLAMP FOR SECURING A POLE TO A STATIONARY OBJECT

[76] Inventor: Samuel Ronci, 416 Mittersill Rd., Franconia, N.H. 03580

[21] Appl. No.: 862,975

[22] Filed: May 23, 1997

[51] Int. Cl.[6] ..... A47B 96/06

[52] U.S. Cl. ..... 248/230.3; 248/214; 248/230.1; 248/296.1

[58] Field of Search ..... 248/229.12, 230.1, 248/230.2, 230.3, 231.31, 231.41, 231.85, 125.1, 316.4, 316.6, 291.1, 292.12, 286.1, 541, 296.1, 214

[56] References Cited

U.S. PATENT DOCUMENTS

| | | | |
|---|---|---|---|
| 2,267,583 | 12/1941 | Carroll | 248/229.12 |
| 2,529,173 | 11/1950 | Moyer et al. | 248/230.1 |
| 3,157,378 | 11/1964 | Blum | 248/218.4 |
| 3,216,752 | 11/1965 | Rifken | 248/230.2 |
| 4,018,412 | 4/1977 | Kees, Jr. et al. | 248/214 |
| 4,547,092 | 10/1985 | Vetter et al. | 248/229.11 |
| 4,796,846 | 1/1989 | Meier et al. | 248/286 |
| 5,538,215 | 7/1996 | Hosey | 248/286.1 |
| 5,735,499 | 4/1998 | Phillips et al. | 248/230.1 |

*Primary Examiner*—Leslie A. Braun
*Assistant Examiner*—Gwendolyn Baxter
*Attorney, Agent, or Firm*—Lorusso & Loud

[57] ABSTRACT

A clamp for securing a pole to a stationary object having a body, an axially traveling plunger disposed within the body, an axially movable piston disposed with the plunger, a threaded cap, and a handle. The clamp is secured to the stationary object, e.g. a surgical rail, by a pair of opposed jaws. The body and the plunger have separate generally egg-shaped bores formed therein through which the pole to be secured is inserted. The handle has a threaded shaft which matingly engages corresponding threads on an inner bore in the cap. The end of the threaded shaft is secured to the piston. As the handle is rotated, the mating threads on the shaft and inner bore of the cap cause the shaft, and the piston connected thereto, to travel axially within the body. Upon continued rotation of the handle, the piston contacts the pole and forces the pole into an elongated end of the generally egg-shaped bore in the plunger. Under the force of the piston and the pole, the plunger travels axially within the body into pressing engagement with the surgical rail. A slot formed in the plunger allows the plunger to expand within the plunger bore in the body upon further rotation of the handle. This expansion of the plunger, removes any "play" or movement between the plunger and the plunger bore and between the pole, the plunger, and the piston.

23 Claims, 4 Drawing Sheets

CLAMP FOR SECURING A POLE TO A STATIONARY OBJECT

FIELD OF THE INVENTION

The present invention relates in general to clamps, and in particular to a pole clamp for releasably securing a pole or shaft to a stationary member.

BACKGROUND OF THE INVENTION

Clamps for securing poles or shafts to stationary members have been developed for use in a variety of applications. Typically, such clamps include a stationary section and a linearly movable section between which the pole or shaft is releasably captured. The clamp itself is usually bolted or otherwise secured to a stationary position, either permanently or temporarily.

In medical and surgical environments, e.g. an operating room or doctors office, such clamps are particularly useful in connection with a variety of applications. For example, in a surgical procedure requiring tractioning a tractioning device is generally secured adjacent the top of a pole to provide an elevated position above the surgical table from which the tractioning may be performed. The pole is secured to the surgical table by a clamp. In these procedures it is imperative that the pole with the tractioning device connected thereto be secured to the operating room table in a reliable, strong, and stable fashion.

Moreover, the traction pole must be secured within the clamp such that the pole is not movable with respect to the clamp, i.e. there must be no "play" or movement between the pole and the clamp. Even the slightest amount of play between the pole and the clamp can translate to a significant amount of undesirable motion at the top of the pole where the tractioning device is anchored. Obviously, motion of the tractioning equipment entirely defeats the intended stable and stationary positioning of the patient's appendage.

In addition, various applications require different poles or shafts having different diameters. In view of the limited space in an operating room, it is cumbersome to stock dedicated clamping systems for each pole diameter. Accordingly, a clamp which can be use to releasably secure poles having a variety of diameters to an operating room table in a facile and efficient, manner is particularly useful.

To date, however, prior art pole clamps have failed achieve the above desirable qualities. Accordingly, there is a long felt need in the art for an adjustable pole clamp which may be used to releasably secure poles of various diameters to a stationary object with no "play" between the pole and the clamp which would result in undesired motion of the pole.

OBJECTS OF THE INVENTION

Accordingly, a primary object of the present invention is to provide a pole clamp for releasably securing a pole to a fixed position with minimized movement or "play" between the pole and the clamp.

Another object of the present invention is to provide a clamp for releasably securing poles of various diameters to a fixed position with minimized movement or "play" between the pole and the clamp.

A further object of the invention is to provide a reliable pole clamp for releasably securing a pole to a fixed position with minimized movement or "play" between the pole and the clamp which is of a simple and cost efficient design.

These and other objects of the present invention will become apparent from a review of the description provided below.

SUMMARY OF THE INVENTION

The present invention is organized about the concept of eliminating or minimizing movement between a pole clamp and a pole secured therein where the pole can be of a variety of diameters. Thus, the clamp of the present invention includes a body, an axially traveling plunger disposed within the body, an axially movable piston disposed with the plunger, a threaded cap, and a handle having a threaded shaft. The clamp is secured to the stationary object, e.g. a surgical rail, by a pair of opposed jaws. The body and the plunger have separate generally egg-shaped bores formed therein through which the pole to be secured is inserted. The threaded shaft on the handle matingly engages corresponding threaded bore in the cap. One end of the threaded shaft is secured to the piston. As the handle is rotated, the mating threads on the shaft and inner bore of the cap cause the shaft, and the piston connected thereto, to travel axially within the body. Upon continued rotation of the handle, the piston contacts the pole and forces the pole against an elongated portion of the generally egg-shaped bore in the plunger. Under the force of the piston and the pole, the plunger travels axially within the body into pressing engagement with the surgical rail. A slot formed in the plunger allows the plunger to expand within the plunger bore in the body upon further rotation of the handle. This expansion of the plunger, removes any "play" or movement between the plunger and the plunger bore and between the pole, the plunger, and the piston. As a result, the pole is reliably and stably secured within the clamp in a manner which minimizes undesired motion in the end of the pole.

BRIEF DESCRIPTION OF THE DRAWING

For a better understanding of the present invention, together with other objects, features and advantages, reference should be made to the following description of the preferred embodiment which should be read in conjunction with the following figures wherein like numerals represent like parts.

DETAILED DESCRIPTION OF THE INVENTION

Figure 1:
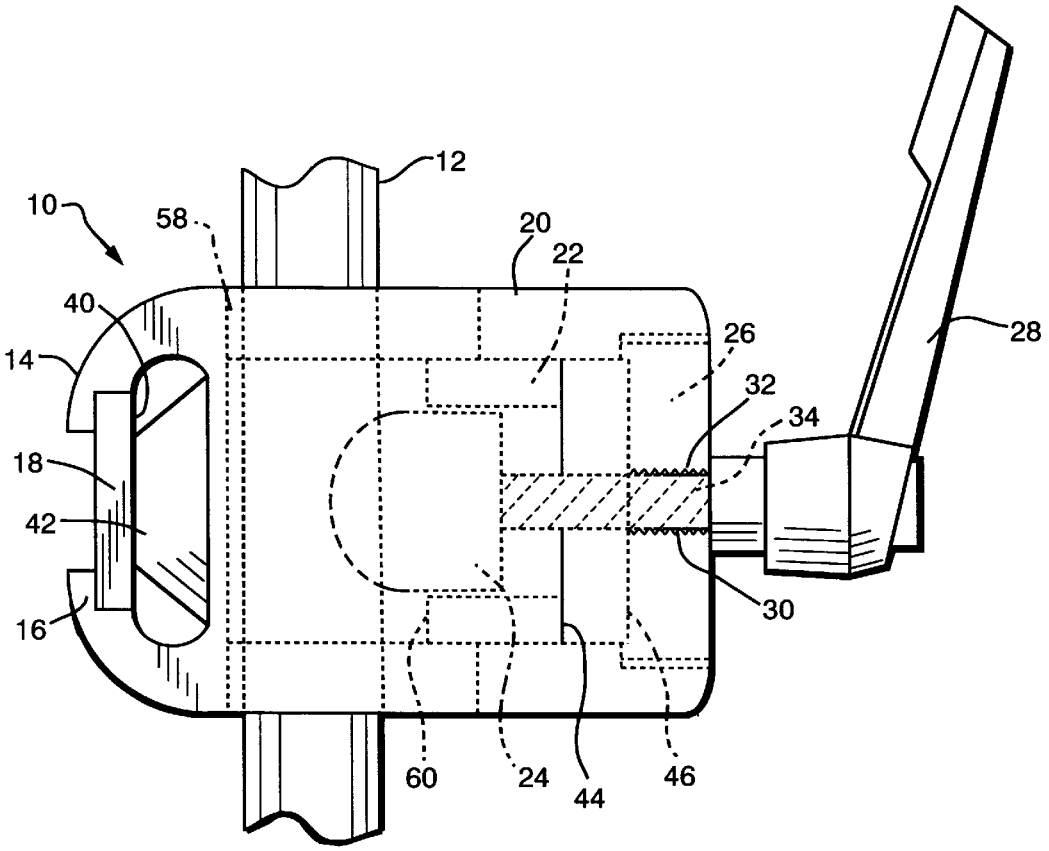
FIG. 1 is a side view of one embodiment of a pole clamp according to the present invention.

Referring to FIG. 1 of the drawing, there is shown a preferred clamp 10 according to the present invention having a pole or shaft 12 secured therein. As shown, the clamp has a pair of opposed mounting jaws 14, 16 formed on an end thereof for mounting the clamp to the rail 18 of a surgical table (not shown). It would, however, be readily apparent to those skilled in the art that the clamp could be modified for mounting to a variety of fixed locations.

Figure 2:
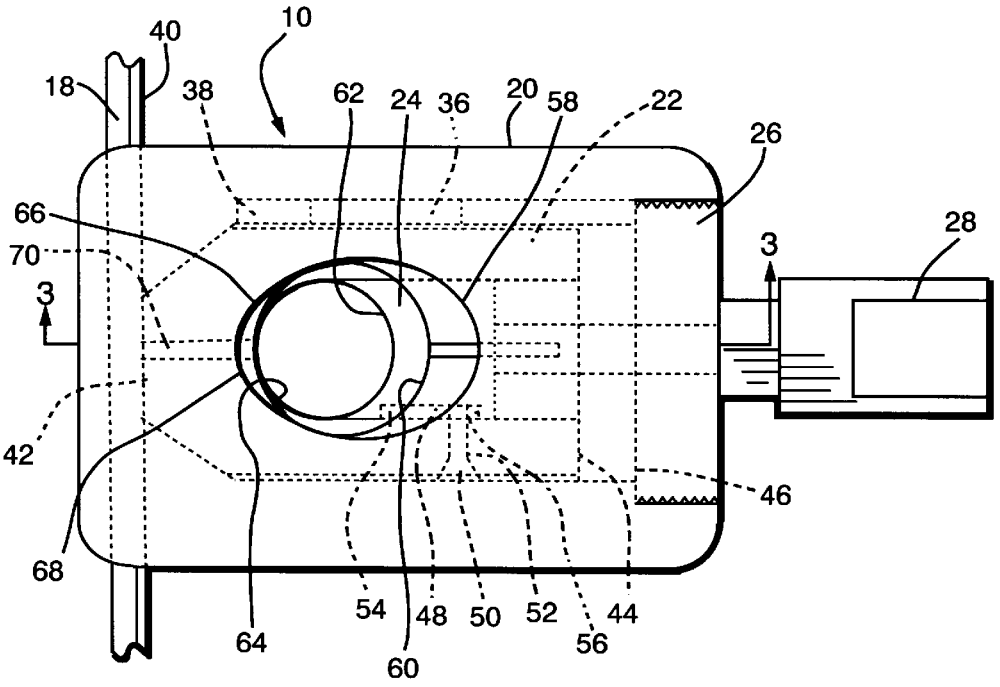
FIG. 2 is a top view of the clamp shown in FIG. 1.

The clamp will now be described in its overall aspects with a more detailed description to follow. As shown in FIGS. 1 and 2, the clamp includes a body 20, an axially traveling plunger 22 disposed within the body, an axially movable piston 24 disposed within the plunger, a threaded cap 26, and a handle 28. The handle has a threaded shaft 30 which matingly engages corresponding threads 32 on a bore 34 in the cap. The end of the threaded shaft is secured to the piston 24. As the handle is rotated, the mating threads on the shaft and bore in the cap cause the shaft, and the piston connected thereto, to travel axially within the body.

The plunger 22 is generally free to move axially within the body and is keyed to the body by the mating engagement of a key 36 on the plunger and a slot 38 formed in the body. Linear travel of the plunger in one direction is limited by the side 40 of the surgical rail which the end 42 of the plunger pressingly engages during use. In the other direction, linear travel of the plunger is limited by the end cap, i.e. the end 44 contacts the end 46 of the end cap.

The piston 24 is disposed within the plunger 22 and is movable therein upon rotation of the handle 28. The piston is keyed to the plunger by the mating engagement of a slot 48 in the piston and a pin 50 which extends through a pin bore 52 in the sidewall of the plunger and into the pin slot 48. Linear travel of the piston 24 relative to the plunger 22 is limited by the engagement of the pin 50 with the ends 54, 56 of the slot in the piston.

To secure a pole or shaft 12 to the clamp, the pole is extended through a body pole bore 58 which is generally egg-shaped in cross-section and a corresponding plunger pole bore 60 in the plunger. The handle is then rotated in a clock-wise direction to move the piston within the plunger in the direction of the pole or clamp. The radiused end 62 of the piston contacts the circumference 64 of the pole, forcing the pole against the surfaces 66, 68 of the elongated end of the egg-shaped bore in the plunger. The plunger 22 moves axially toward the surgical rail 18 until it contacts the side 40 of the rail. As the handle is continually rotated, increasing pressure is applied by the piston 24 against the pole 12 and against the surfaces of the elongated end of the egg-shaped bore in the plunger.

Advantageously, the plunger includes a central slot 70 which extends axially through the plunger. As the pole 12 is forced into the surfaces 66, 68 by the piston, the slot 70 allows the plunger to expand radially, eliminating any movement or "play" between the pole, the plunger, and the piston. As a result, the pole or shaft is securely fixed within the clamp with no undesired movement of the distal end of the pole resulting from play in the clamp/pole interface.

Figure 3:
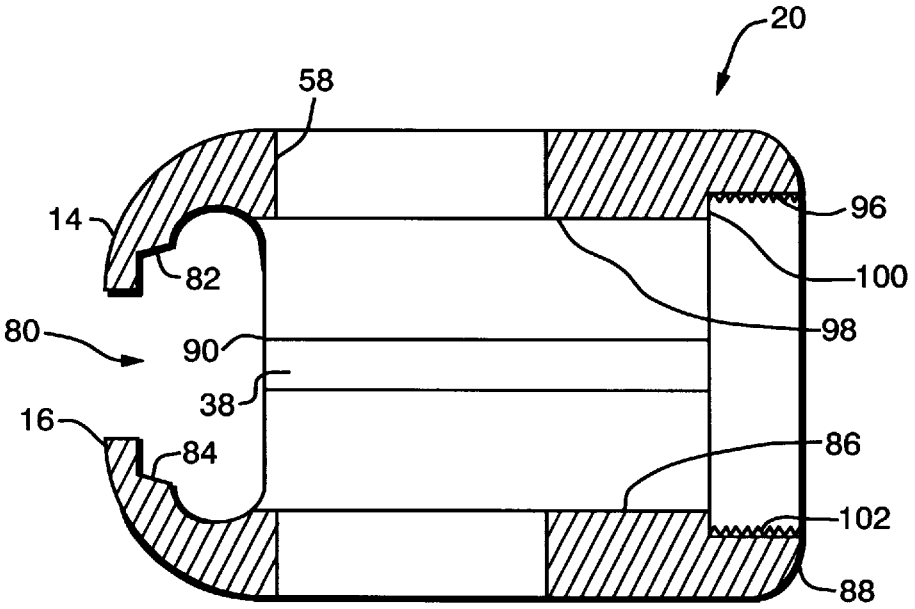
FIG. 3 is a side sectional view of a preferred clamp body according to the present invention taken along lines III—III of FIG. 2.
Figure 4:
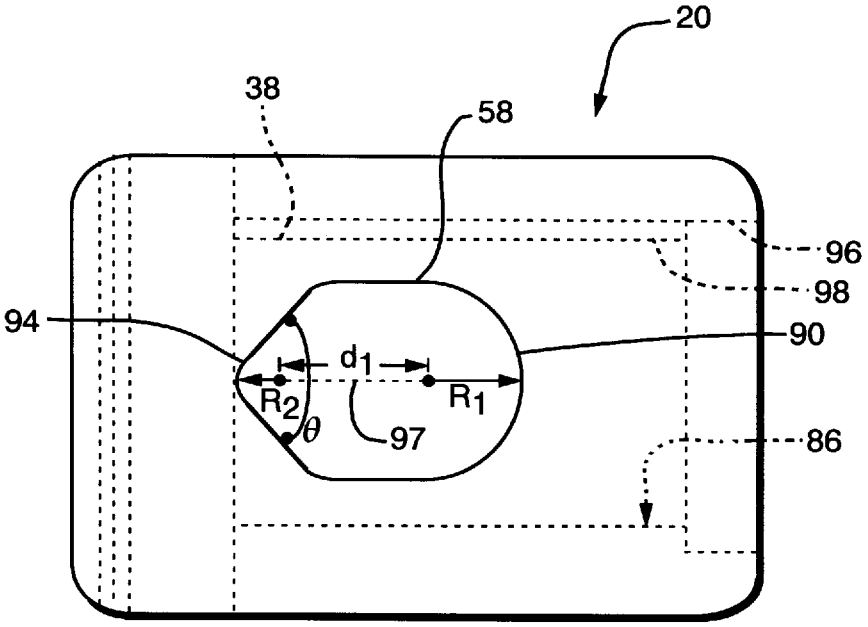
FIG. 4 is a top view of the clamp body shown in FIG. 3.

Turning now to FIGS. 3–4, a more detailed description of the clamp body 20 will now be provided. The body, the plunger, and the cap are preferably of unitary construction machined or die-cast from aluminum. As shown, the body includes a pair of opposed jaws 14, 16 for securing the clamp to a stationary object, e.g. a surgical table rail. The body is rotated upwardly until the edge of the rail fits within the opening 80 between the jaws. The body is then rotated until the rail is positioned between opposing stepped portions 82, 84 of the jaws, as shown in FIG. 1. As discussed above, the pressing engagement of the plunger against the side of the rail, in combination with the jaws, secures the clamp to the rail in a stable manner.

The body preferably includes a body pole bore 58 which is generally egg-shaped in cross section and extends through the body in axial alignment with the axis of the pole to be secured, and a generally cylindrical plunger bore 86 which perpendicularly intersects the body pole bore and extends completely through the body from a first end 88 to a second end thereof. The body pole bore, as shown particularly in FIG. 4, preferably has a first radiused end 92 and a second elongated end 94. Preferably, the elongated end has an inner angle θ of approximately 90°. The dimensions of the bore depend on the diameter of the pole to be received therein. In the preferred embodiment however, the first radiused end 92 has a radius r1 of approximately 0.504", and the end of the second elongated portion 94 has a radius r2 of about 0.25" measured from a distance d of approximately 0.683" along the major axis 97 of the bore. These dimensions allow a pole having, a diameter from about 0.625" to 1.0" to be received and secured by the clamp.

The plunger bore 86 includes a first large diameter portion 96 and a second reduced diameter portion 98 defining a step 100. The large diameter portion includes threads 102 thereon which mate with threads 162 on the cap 26 (FIG. 11) for securing the cap to the body. The smaller diameter portion 98 of the plunger bore is dimensioned to receive the plunger for axial movement therein. The slot 38 is formed along the length of the bore, as shown. The key 36 (FIG.2) on the plunger rides within the slot 38 to prevent rotation of the plunger within the bore.

Figure 5:
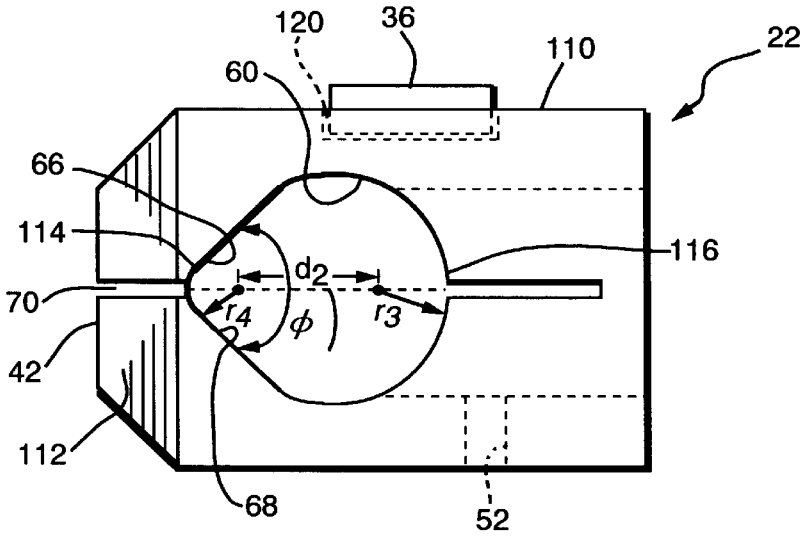
FIG. 5 is a top view of a preferred plunger according to the present invention.
Figure 6:
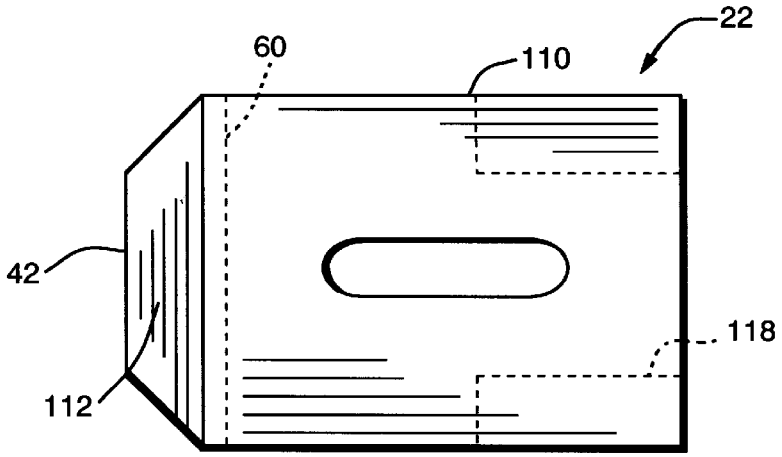
FIG. 6 is a side view of the plunger shown in FIG. 5 showing a first side of the plunger.
Figure 7:
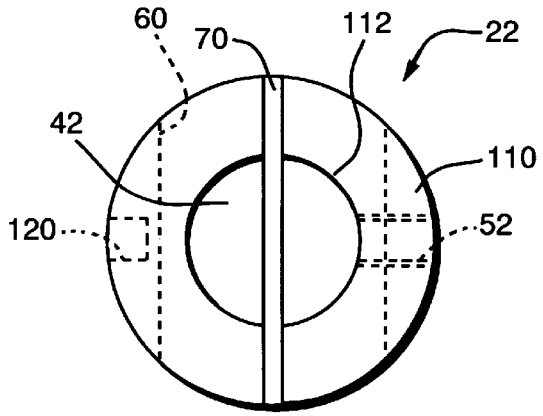
FIG. 7 is an end view of the plunger shown in FIG. 5 showing the extension of a slot through the plunger.

The plunger, as shown particularly in FIGS. 5–7, is also either machined or die cast from aluminum. The plunger has a first cylindrical portion 110 with a frusto-conical end portion 112 having an end surface 42 for contacting the surgical rail 18 (FIG.1). A plunger pole bore 60 which is generally egg-shaped in cross section is formed through the cylindrical portion 110 in alignment with the pole or shaft to be secured by the clamp. The plunger pole bore, as shown particularly in FIG. 5, has a first radiused end 116 and a second elongated end 114. Preferably, the elongated end 114 is formed with an inner angle Φ of approximately 90°. Again, the dimensions of the bore depend on the diameter of the pole to be received therein. In the preferred embodiment however, the first radiused end 116 has a radius r3 of approximately 0.502–0.503", and the second elongated portion end 114 has a radius r4 of about 0.25" measured from a distance d of approximately 0.354" along the major axis 115 of the bore.

A cylindrical piston bore 118 perpendicularly intersects the plunger pole bore and extends completely through the first cylindrical portion 110 of the plunger in axial alignment therewith for receiving the piston. As shorn also in FIG. 7, the piston bore is perpendicularly intersected by a pin bore 52. The pin bore is adapted to receive a pin 50 (FIG. 2), e.g. a screw, which extends through the pin bore 52 and into a corresponding slot in the piston to limit linear travel of piston within the piston bore.

On an opposite side of the plunger, as shown particularly in FIGS. 5 and 6, a slot 120 is formed in the exterior surface for receiving the key 36 which mates with the corresponding slot in the body. The key 36 is preferably formed of stainless steel and is press-fit within the slot 120. The mating engagement of the slot with the key forces proper alignment of the plunger pole bore with the body pole bore and prevents rotation of the plunger within the body. Although the key is preferably formed as a separate part, it is to be understood that the key could be formed integrally from the material of the plunger. Also, the key and the corresponding slot formed in the body could take a variety of shapes and sizes.

As shown particularly in FIGS. 5 and 7, the plunger is formed with a slot 70 extending axially through the plunger and across the diameter of the plunger. The slot is preferably centered on the major axis d2 of the plunger pole bore and passes axially through the frusto-conical portion, the plunger pole bore, and a portion of the cylindrical body of the plunger. For example, in a preferred embodiment wherein the aluminum plunger has a length of 2.36", the slot extends axially through the plunger from the frusto-conical end through the cylindrical body a length of 2.17".

Advantageously, the slot divides the plunger pole bore into two sections defined by separable first and second surfaces 68, 66. This allows expansion of the plunger diameter within the plunger bore of the body as the piston forces the pole or shaft against the separable surfaces 68, 66 at the elongated end 114 of the plunger pole bore. Expansion of the plunger in this manner eliminates any play between the plunger and the body, and between the plunger pole bore 60, the pole 12, and the piston 24.

Figure 8:
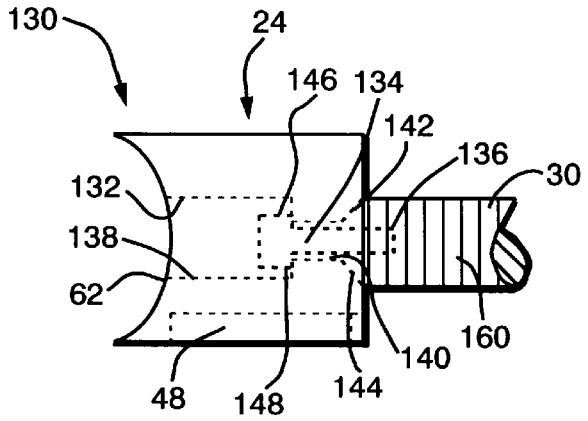
FIG. 8 is a top view of a preferred clamp piston according to the present invention.
Figure 9:
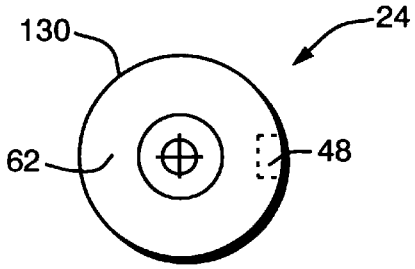
FIG. 9 is an end view of the piston shown in FIG. 8.

The piston 24, as shown particularly in FIGS. 8 and 9, is a generally cylindrical member, and is preferably machined from stainless-steel. The piston has a concave radiused pole contacting surface at one end 130 thereof. The radius defined by the pole contacting surface depends on the size of the pole to be clamped. However, in a preferred embodiment, the concave pole contacting surface 62 is formed with a radius of 0.501–0.503" with the piston having a diameter of about 0.874–0.875"and total length of about 1.063".

To limit linear travel of the piston within the piston bore of the plunger and to force proper orientation of the piston within the plunger, the piston 24 is keyed to the plunger 22 by the mating engagement of a pin inserted through the pin bore 52 (FIG. 5) of the plunger and into the pin slot 48 in the piston, as shown particularly in FIGS. 8 and 9. The slot 48 is oriented on the piston so that when the piston is inserted into the piston bore 118 of the plunger, the pole contacting surface 62 contacts the circumference of the pole 12, as shown in FIG. 2.

To secure the piston 24 to the threaded shaft 30 of the handle, an axial bore 132 is formed in the piston through which a screw 134 may be passed to engage a threaded mating bore 136 in the threaded shaft. As shown in FIGS. 8 and 9, the bore 132 has a has a large diameter portion 138, a reduced diameter portion 140, and a frusto-conical portion 142. To secure the threaded shaft to the piston, the frusto-conical end 144 of the threaded shaft 30 is inserted into the frusto-conical portion 142 of the bore. The screw 134 is then inserted through the large diameter portion 138 of the bore and its shaft is extended reduced diameter portion 140 into the mating threaded axial bore 136 in the frusto-conical end of the threaded shaft 30. Once secured to the threaded shaft, the head of the screw 146 rests against the shelf 148 at the transition from the large diameter portion of the bore to the reduced diameter portion. With this arrangement, the screw 134 is free to rotate within the large and reduced diameter portions of the bore so as not to cause rotation of the piston upon rotation of the threaded shaft.

Figure 10:
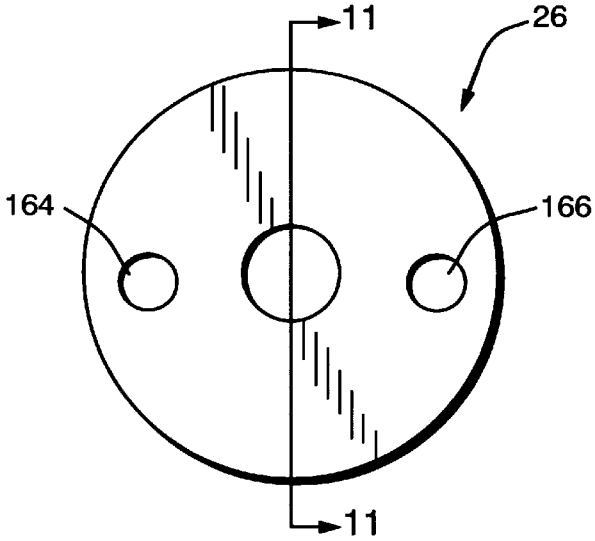
FIG. 10 is an end view of a preferred clamp cap according to the present invention.
Figure 11:
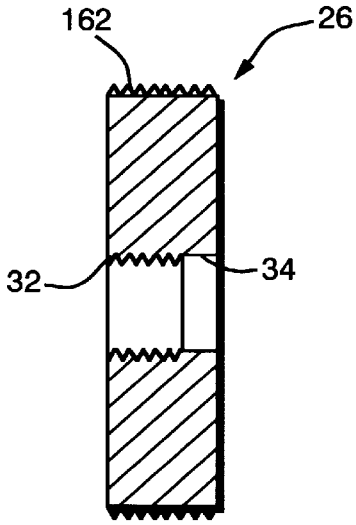
FIG. 11 is a side sectional view of the cap shown in FIG. 10 taken along lines XI—XI.

Turning also to FIGS. 10 and 11, mating engagement of the threads 160 on the threaded shaft and the threads 32 on the interior surface of a bore 34 formed in the cap causes the threaded shaft and the piston attached thereto to travel axially within the body depending on the direction of rotation. To secure the cap to the body, the cap is provided with threads 162 on the exterior surface thereof which matingly engage corresponding threads 102 (FIG.3) on the body. After installation of the plunger, the piston, and the lead screw into the body, the cap is secured to the body by rotating the cap to engage the mating threads on the cap and body. To facilitate installation and removal of the cap, recesses 164, 166 are formed in the end of the cap for receiving a key (not shown) which provides rotational leverage.

Thus, according to the present invention there is provided a clamp for securing a pole to a fixed position with minimized movement or play between the pole and the clamp to prevent undesired movement in the pole. The clamp includes a body, an axially traveling plunger disposed within the body, an axially movable piston disposed with the plunger, a threaded cap, and a handle. The body and the plunger have separate generally egg-shaped pole bores formed therein through which the pole to be secured is inserted. The handle has a threaded shaft which matingly engages corresponding threads on an inner bore in the cap. The end of the threaded shaft is secured to the piston. As the handle is rotated, the mating threads on the shaft and inner bore of the cap cause the shaft, and the piston connected thereto, to travel axially within the body. Upon continued rotation of the handle the piston contacts the pole and forces the pole into an elongated end of the generally egg-shaped pole bore in the plunger. Under the force of the piston and the pole, the plunger travels axially within the body to pressingly engage the surgical rail. A slot formed in the plunger allows the plunger to expand within the plunger bore in the body upon further rotation of the handle. This expansion of the plunger, removes any "play" or movement between the plunger and the body and between the pole, the plunger, and the piston. To remove the pole, the handle is merely rotated in the opposite direction to release the pressure applied by the piston against the pole.

The embodiments which have been described herein, however, are but some of the several which utilize this invention and are set forth here by way of illustration but not of limitation. For example, the body, plunger, piston, handle, and cap could be of any size depending on the dimensions of the pole to be clamped. Also linear travel of the plunger within the body could be limited by a projection on the body or other means, instead of by contact with the surgical rail. In addition, the clamp could be formed form a variety of metallic or plastic materials. It is obvious that many other embodiments, which will be readily apparent to those skilled in the art, may be made without departing materially from the spirit and scope of this invention.

What is claimed is:

1. A clamp for securing a pole to a stationary object, said clamp comprising:

a body, said body having a body pole bore formed therein for receiving said pole;

a plunger disposed in said body and being movable in said body, said plunger having a plunger pole bore formed therein for receiving said pole and a slot formed therein for allowing expansion of said plunger upon urging of said pole against a surface of said plunger pole bore;

a piston disposed in said plunger, said piston having a first and a second end and being movable in said plunger, said first end of said piston having a pole contacting surface; and a shaft secured to said second end of said piston for causing movement of said piston within said plunger upon rotation of said shaft, wherein said piston moves within said plunger upon rotation of said shaft for forcing said pole contacting surface against said pole and thereby urging said pole against said surface of said plunger pole bore to cause expansion of said plunger within said body.

2. The clamp according to claim 1, wherein said body pole bore is generally egg-shaped in cross-section.

3. The clamp according to claim 1, wherein said body includes a plunger bore which perpendicularly intersects said body pole bore, and wherein said plunger is disposed within said plunger bore for axial movement therein.

4. The clamp according to claim 3, wherein said plunger has a key extending from an exterior surface thereof which slidably mates with a slot formed in said body.

5. The clamp according to claim 1, wherein said plunger pole bore is generally egg-shaped in cross-section.

6. The clamp according to claim 1, wherein said plunger includes a piston bore which perpendicularly intersects said plunger pole bore, and wherein said piston is disposed within said piston bore for axial movement therein.

7. The clamp according to claim 6, wherein said plunger includes a pin bore which perpendicularly intersects said piston bore in alignment with a pin slot formed in said piston, and wherein said piston is keyed to said plunger by a pin extending through said pin bore and into said pin slot.

8. The clamp according to claim 1, wherein said slot extends axially through said plunger to separate the plunger pole bore into two sections.

9. The clamp according to claim 1, wherein said piston includes an axial bore therein and said shaft has an axial bore in an end thereof, and wherein said piston is rotatably secured to said shaft by a screw which extends through said axial bore in said piston and into said axial bore in said shaft.

10. The clamp according to claim 1, said clamp further comprising a cap secured to an end of said body, said cap having a threaded bore formed therein, wherein said shaft extends through said threaded bore into said body with threads on said shaft matingly engaging corresponding threads on said threaded bore for causing axial movement of said shaft and said piston within said body.

11. The clamp according to claim 1, wherein said body has a pair of opposed jaws formed thereon, said jaws being dimensioned to receive said stationary object therebetween to secure said clamp to said stationary object.

12. A clamp for securing a pole to a stationary object, said clamp comprising:

a body, said body having a body pole bore formed therein which is generally egg-shaped in cross section for receiving said pole, and a plunger bore perpendicularly intersecting said body pole bore;

a plunger disposed in said plunger bore and being axially movable therein, said plunger having a plunger pole bore formed therein which is generally egg-shaped in cross section for receiving said pole, a piston bore axially intersecting said plunger pole bore, and a slot formed therein for allowing expansion of said plunger upon urging of said pole against a surface of said plunger pole bore;

a piston disposed in said piston bore, said piston having a first and a second end and being axially movable in said piston bore, said first end of said piston having a concave radiused pole contacting surface; and a shaft secured to said second end of said piston for causing axial movement of said piston within said piston bore upon rotation of said shaft, wherein said piston moves within said piston bore upon rotation of said shaft for forcing said pole contacting surface against said pole and thereby urging said pole against said surface of said plunger pole bore to cause expansion of said plunger within said body.

13. A method of securing a pole to a stationary object comprising:

providing a clamp, said clamp comprising:

a body, said body having a body pole bore formed therein for receiving said pole;

a plunger disposed in said body and being movable in said body, said plunger having a plunger pole bore formed therein for receiving said pole and a slot formed therein for allowing expansion of said plunger upon urging of said pole against a surface of said plunger pole bore;

a piston disposed in said plunger, said piston having a first and a second end and being movable in said plunger, said first end of said piston having a pole contacting surface; and a shaft secured to said second end of said piston for causing movement of said piston within said plunger upon rotation of said shaft, wherein said piston moves within said plunger upon rotation of said shaft for forcing said pole contacting surface against said pole and thereby urging said pole against said surface of said plunger pole bore to cause expansion of said plunger within said body;

securing said clamp to said stationary object;

inserting said pole through said body pole bore and said plunger pole bore; and rotating said shaft to force said pole contacting surface against said pole.

14. The method according to claim 13, wherein said body pole bore is generally egg-shaped in cross-section.

15. The method according to claim 13, wherein said body includes a plunger bore which perpendicularly intersects said body pole bore, and wherein said plunger is disposed within said plunger bore for axial movement therein.

16. The method according to claim 15, wherein said plunger has a key extending from an exterior surface thereof which slidably mates with a slot formed in said body.

17. The method according to claim 13, wherein said plunger pole bore is generally egg-shaped in cross-section.

18. The method according to claim 13, wherein said plunger includes a piston bore which perpendicularly intersects said plunger pole bore, and wherein said piston is disposed within said piston bore for axial movement therein.

19. The method according to claim 18, wherein said plunger includes a pin bore which perpendicularly intersects said piston bore in alignment with a pin slot formed in said piston, and wherein said piston is keyed to said plunger by a pin extending through said pin bore and into said pin slot.

20. The method according to claim 13, wherein said slot extends axially through said plunger to separate the plunger pole bore into two sections.

21. The method according to claim 13, wherein said piston includes an axial bore therein and said shaft has an axial bore in an end thereof, and wherein said piston is rotatably secured to said shaft by a screw which extends through said axial bore in said piston and into said axial bore in said shaft.

22. The method according to claim 13, said clamp further comprising a cap secured to an end of said body, said cap having a threaded bore formed therein, wherein said shaft extends through said threaded bore into said body with threads on said shaft matingly engaging corresponding threads on said threaded bore for causing axial movement of said shaft and said piston within said body.

23. The method according to claim 13, wherein said body has a pair of opposed jaws formed thereon, said jaws being dimensioned to receive said stationary object therebetween to secure said clamp to said stationary object.

* * * * *